US012258167B2

(12) United States Patent
Czepluch

(10) Patent No.: US 12,258,167 B2
(45) Date of Patent: Mar. 25, 2025

(54) METHOD AND DEVICE FOR SEALING PACKAGES

(71) Applicant: C-PACK VERPACKUNGSMASCHINEN GMBH, Tornesch (DE)

(72) Inventor: Jörg Czepluch, Tornesch (DE)

(73) Assignee: C-PACK VERPACKUNGSMASCHINEN GMBH, Tornesch (DE)

( * ) Notice: Subject to any disclaimer, the term of this patent is extended or adjusted under 35 U.S.C. 154(b) by 256 days.

(21) Appl. No.: 17/609,488

(22) PCT Filed: Apr. 17, 2020

(86) PCT No.: PCT/DE2020/000080
§ 371 (c)(1),
(2) Date: Nov. 8, 2021

(87) PCT Pub. No.: WO2020/224688
PCT Pub. Date: Nov. 12, 2020

(65) Prior Publication Data

US 2022/0227516 A1 Jul. 21, 2022

(30) Foreign Application Priority Data

May 6, 2019 (DE) ..... 10 2019 111 657.0

(51) Int. Cl.
*B65B 51/22* (2006.01)
*B65B 9/12* (2006.01)
*B65B 51/04* (2006.01)

(52) U.S. Cl.
CPC ..... *B65B 51/225* (2013.01); *B65B 51/046* (2013.01); *B65B 9/12* (2013.01)

(58) Field of Classification Search
CPC ..... B65B 51/225; B65B 51/046; B65B 9/10; B65B 51/04; B65B 61/14; B65B 25/04;
(Continued)

(56) References Cited

U.S. PATENT DOCUMENTS 2,908,123 A 10/1959 Müller
6,023,918 A 2/2000 Czepluch
(Continued)

FOREIGN PATENT DOCUMENTS

EP 0823376 A1 2/1998
EP 0887271 A1 12/1998
(Continued)

OTHER PUBLICATIONS

International Search Report Dated Jul. 22, 2020, PCT/DE2020/000080, 3 Pages.

*Primary Examiner* — Veronica Martin
(74) *Attorney, Agent, or Firm* — LUCAS & MERCANTI, LLP; Klaus P. Stoffel

(57) ABSTRACT

A device for sealing packages, including a product feed and a packaging feed for a tubular packaging material; and a method for sealing packages. Such devices are used, for example, as tubular bag machines. The packages can be produced by type for improved recyclability while simultaneously maintaining a high load-bearing capacity of the package closures with the aid of a closure element made of the same material as the rest of the package by welding the closure element and the package in the closure region.

7 Claims, 3 Drawing Sheets

(58) Field of Classification Search
CPC ..... B65B 9/15; B65B 25/048; B65B 51/146; B29C 65/08; B29C 66/1122; B29C 65/7451; B29C 66/4312; B29C 66/81431
See application file for complete search history.

(56) References Cited

U.S. PATENT DOCUMENTS

| | | | | |
|---|---|---|---|---|
| 6,212,861 | B1 * | 4/2001 | Tsuruta | B29C 66/004 53/374.6 |
| 6,761,012 | B2 * | 7/2004 | Rusert | B65B 9/20 53/410 |
| 9,920,623 | B1 * | 3/2018 | Leeper | B65B 51/225 |
| 2010/0154359 | A1 * | 6/2010 | Giro Amigo | B65B 9/15 53/450 |
| 2010/0154363 | A1 * | 6/2010 | Giro Amigo | B29C 65/7451 53/479 |
| 2013/0039607 | A1 * | 2/2013 | Giro Amigo | B65D 33/10 383/71 |
| 2017/0225815 | A1 * | 8/2017 | Perugini | B29C 66/83221 |
| 2020/0122894 | A1 * | 4/2020 | Hawighorst | B65B 43/465 |

FOREIGN PATENT DOCUMENTS

| | | | |
|---|---|---|---|
| EP | 0960822 | A1 | 12/1999 |
| EP | 1522497 | A1 | 4/2005 |
| EP | 3181464 | A1 | 6/2017 |
| ES | 2257974 | A1 | 8/2006 |

* cited by examiner

METHOD AND DEVICE FOR SEALING PACKAGES

CROSS-REFERENCE TO RELATED APPLICATIONS

The present application is a 371 of International application PCT/DE2020/000080, filed Apr. 17, 2020, which claims priority of DE 10 2019 111 657.0, filed May 6, 2019, the priority of these applications is hereby claimed and these applications are incorporated herein by reference.

BACKGROUND OF THE INVENTION

The invention relates to a device for sealing packages, having a product feed unit and a packaging means feed unit for a tubular packaging material. Devices of this type are used, for example, as tubular bag machines.

The invention furthermore relates to a method for sealing packages.

According to the prior art, devices for sealing packages, having a product feed unit and a packaging means feed unit for a tubular packaging material are used, for example, in order to fill net-like and/or tubular packaging materials with fruit or vegetables and to seal the packages. After the products to be packed have been portioned, which step is performed, for example, with the aid of a weighing device or a counting device, they are passed into the region of the tubular packaging material via the product feed unit. The tubular packaging material has been sealed beforehand at one end by means of a sealing device such that the product to be packed is fed into the packaging tube sealed on one side. After it has been filled with a defined amount of product, the packaging tube is also sealed at the second end by means of a sealing device and separated from the packaging stock by means of a separating device.

It has proven to be particularly advantageous according to the prior art to simultaneously seal in parallel in one production step the second end of a first already filled packaging tube and the first end of a second packaging tube.

High demands are made here on the load-bearing capacity of the packaging seals so that the packages do not open inadvertently when handled subsequently. Care needs to be taken here in particular about the relatively high weight of the products which are sometimes packaged in this form of package, such as, for example, potatoes or oranges.

According to the prior art, sealing strips which are generally manufactured from metal strips are therefore used as sealing elements which are cut to length in the region of the device for sealing packages and are then bent around the ends of the packaging tube like clips in the sealing region.

Alternatively, devices for sealing packages are also known in which metal sealing strips cut to length externally are used.

As environmental demands increase, there is a further demand for packages to be as fully and simply recyclable as possible.

In addition to the selection of recyclable materials for packages, it is therefore advantageous if as few different materials as possible are used for a package. Ideally, packages are thus made from a single recyclable material and are hence of a single type.

However, the net-like and/or tubular packages sealed by means of known devices have two metal clips, arranged in each case at each end of the package, as sealing elements which need to be separated from the rest of the package in a time-consuming fashion when the packages are recycled.

A device for packing products is already known from EP 0 887 271 A1 which has a heat-sealing element, by means of which the package can be fused in the sealing region, for the purpose of sealing a tubular package. The use of sealing elements, also made from a different material from the remainder of the package, such as for example metal, can be completely dispensed with by sealing the tubular package using heat seals. Disadvantages of the known devices and methods for sealing tubular packaging material with the aid of heat-sealing elements are, however, a lower load-bearing capacity of the sealed seam of the package compared with the use of a metal sealing element, the more complex production of corresponding devices for packaging products and sealing the packages, and packaging cycles which are extended by the need to cool both the heat-sealing elements and the heat-sealed seams.

SUMMARY OF THE INVENTION

An object of the invention is therefore to provide a device for sealing packages which enables the packaging of products in a tubular packaging material and the sealing of the tubular packages in an improved fashion.

A further object of the invention is to provide a device for sealing packages which enables the packaging of products in tubular packages and the sealing of the tubular packages in such a way that the package comprises as few different materials as possible.

A further object of the invention is to provide an improved method for sealing packages, in which products are packaged in a tubular package and the tubular packages are sealed.

A further object of the invention is to provide a method for sealing packages, in which products are packaged in a tubular package and the packages are sealed, wherein the packages comprise as few different materials as possible.

The features of the invention disclosed below are part of the invention both in all configurable subcombinations and in the combination of all disclosed features. A device according to the invention for sealing packages has at least one sealing device by means of which at least one end of at least one tubular package can be sealed by being materially bonded in a sealing region.

A sealed tubular package here has at least two sealing regions, a first sealing region of which is arranged in the region of the first end and a second sealing region of which is arranged in the region of the second end of the tubular package.

A package of this type is formed, for example, as a netting bag and has precisely two sealing regions arranged respectively at an end of the package.

In an embodiment according to the invention, a tubular package can be sealed in at least one sealing region with a sealing element formed as a sealing strip by means of a device for sealing packages.

In a preferred embodiment of the invention, a tubular package can be sealed with a sealing strip made from the same metal as the rest of the package so that packages of a single type can be produced.

The packaging material is here generally provided as a thermofusible or thermally weldable plastic.

In an embodiment of the invention, the device for sealing packages for this purpose has a transport apparatus for at least one sealing tape and/or one sealing strip.

In a preferred embodiment of the invention, the transport device has at least one drive roll, particularly preferably two drive rolls.

In an embodiment of the invention, it has a cutting device by means of which the sealing tape can be cut into sealing strips of a defined length. In an embodiment of the invention, it has a forming device by means of which a sealing strip can be formed.

In a preferred embodiment of the invention, the sealing strip can be formed into a U shape by means of the forming device.

In an embodiment of the invention, the forming device has a pusher, formed for example as a bending pin, and a die with a U-shaped contour, wherein the sealing strip can be pushed into the die with a U-shaped contour by the pusher and can consequently be formed into a U shape.

In a further embodiment of the invention, the device for sealing packages has a bending device by means of which at least one sealing strip can be bent around at least one end of a package such that a package can be enclosed respectively in a sealing region with the aid of at least one sealing strip.

In a preferred embodiment of a device for sealing packages according to the invention, it has, for the purpose of sealing packages with a sealing tape made from the same material, a sealing device formed as a welding device by means of which at least one sealing strip can be welded to the material of at least one package.

In a particularly preferred embodiment of a device for sealing according to the invention, the welding device is formed as an ultrasonic welding device. The use of an ultrasonic welding device enables an improved production cycle compared with conventional welding devices or heat-sealing elements because the temperature required to produce the weld seam is created essentially only in the region of the weld seam and the surrounding elements of the device for sealing packages do not heat up unnecessarily such that they no longer need to be cooled after each production cycle.

In a preferred embodiment, the ultrasonic welding device is formed as an ultrasonic sonotrode.

In a further embodiment according to the invention, a device for sealing packages has at least one ultrasonic welding device by means of which two weld seams can be produced at the same time.

In a particularly preferred embodiment of the invention, for this purpose it has a U-shaped ultrasonic sonotrode, wherein ultrasonic welds can be produced in the two end regions of the U-shaped ultrasonic sonotrode.

In a further embodiment according to the invention, the sealing device for the materially bonded connection of sealing strips and packaging has an adhesive-bonding device. Sealing strips and packaging can be connected together adhesively by means of the adhesive-bonding device.

In a further preferred embodiment of a device for sealing packages according to the invention, it has at least one cooling apparatus by means of which the at least one sealing region can be cooled after the connection of at least one package and at least one sealing strip. By virtue of the cooling of the weld seam after the welding of the sealing strip and the package, the weld seam is load-bearing after a short period of time such that an increased production rate can be obtained.

In a preferred embodiment of the invention, the cooling apparatus is formed as a cold air feed unit.

In order to immobilize the package and to relieve stress on the weld seam when it is hot, in one embodiment a device for sealing packages according to the invention has at least one clamping device by means of which a tubular package or the packaging tube can be clamped on at least one side in the vicinity of the region of a weld seam to be produced, i.e. in the vicinity of the sealing region. As a result, stress on the weld seam when it is hot can be relieved such that undesired deformations of the material owing to the action of force, in particular owing to the dead weight of the package which may be filled, can be effectively avoided.

In an embodiment of the invention, it has two clamping devices, wherein a first package can be clamped by means of the first clamping device in the vicinity of a sealing region and a second package can be clamped by means of the second clamping device in the vicinity of a sealing region.

In an embodiment of the invention, it has a separating device by means of which the packaging tube can be severed such that sealed packages can be separated from the packaging stock.

In a preferred embodiment of the invention, the separating device is formed as a cutting tool.

In a particularly preferred embodiment of the invention, it is designed for the simultaneous production of two weld seams, one weld seam on each package, wherein the two packages can be separated from each other between the weld seams by means of the separating device.

In an embodiment of the invention, it has a packaging means feed unit via which the tubular packaging material can be fed from the packaging means stock into the region of the sealing device.

In an embodiment of the invention, it has a packaging means storage apparatus by means of which tubular packaging material can be stored in the region of the device for sealing packages.

In a preferred embodiment of the invention, the packaging means storage apparatus is formed as at least one tube onto which the tubular packaging means is pushed and which thus constitutes the packaging means stock.

The design of the packaging means storage apparatus as a tube furthermore enables the tubular packages to be filled through the tube.

In an embodiment of the invention, it has at least one product feed unit by means of which the tubular package can be filled with the products to be packaged.

In a further embodiment of the invention, it has at least one weighing device for portioning the products to be filled and packaged.

In an embodiment of the invention, it is designed for sealing packaging nets.

In particular for the packaging material and the material of the sealing tape or the sealing elements formed as sealing strips, it has been considered to use recyclable plastics such as, for example, polyurethane and HDPE, or to use biodegradable and thermally weldable materials such as, for example, starch or cellulose.

The combination of at least one ultrasonic welding device and the use of sealing elements formed as sealing strips of the same material as the rest of the package makes it possible, owing to a preferred embodiment of a device for sealing packages according to the invention, to produce tubular packages of a single type with a high load-bearing capacity of the weld seams or the seals.

A method for sealing packages according to the invention comprises, as a method step, enclosing a sealing region of a package with a sealing strip and, as a further method step, connecting it to the package by welding and/or adhesively bonding the sealing strip.

In a preferred embodiment of the method for sealing packages according to the invention, ultrasonic welding is performed of the sealing element formed as a sealing strip and the package.

In a further embodiment of a method for sealing packages according to the invention, in a sequence of method steps at least one sealing strip is produced by being cut to length from at least one sealing tape and the at least one sealing strip is bent around the package.

In a particularly preferred embodiment of a method for sealing packages according to the invention, a device for sealing packages according to the invention is used.

In a further embodiment according to the invention, the method for sealing packages comprises the following method steps:

- clamping the tubular package in the vicinity of the sealing region with a clamping device
- bending the sealing strip around the tubular package in the sealing region
- ultrasonically welding the sealing strip to the tubular package in the sealing region
- cooling the sealing region with the aid of a cooling apparatus
- separating the tubular package from the packaging means stock with the aid of a separating device.

In an embodiment of the method for sealing packages according to the invention, in a further method step the tubular package is filled with a product.

In a further embodiment of the method for sealing products according to the invention, the sealing strip is provided by the following method steps:

- transporting the sealing tape with the aid of a transporting apparatus
- cutting a sealing tape to length to form a sealing strip with the aid of a cutting device
- forming the sealing strip into a U shape with the aid of a forming device.

Transporting the sealing tape here comprises, for example, unreeling the sealing tape from a roll of sealing tape and feeding the sealing tape into the region of a cutting device for cutting the sealing tape to length with the aid of a transporting apparatus.

The order of the above-disclosed method steps is not necessarily fixed by the order in which they have been listed. In particular, multiple similar or different method steps can also be carried out in parallel.

For example, multiple sealing elements formed as sealing strips can be produced simultaneously and/or multiple sealing elements as can be welded simultaneously in to one or more packages.

It has in particular also been considered to simultaneously clamp at least one package and weld the at least one package to a sealing element.

Also part of the invention is a package having a tubular body which is designed to be filled with pourable products, wherein the package is sealed in the region of both ends by respectively at least one sealing element, characterized in that it is a package of a single type made from thermofusible plastic or starch or cellulose, wherein the sealing elements are connected in each case in a sealing region to the package by thermal welding.

The terms tubular and/or net-like which are used are each to be interpreted widely and to be understood generally such that the package has a form like a tube at least in places, wherein the wall material can be designed as closed or with recesses, as a result of which a net-like form can in particular be obtained. However, owing to the flexibility of the wall material, the form of the package is non-stable, corresponding to a bag or a sack.

The invention acknowledges that, by virtue of the superposed layers of packaging material which occur in the sealing region owing to the package being compressed, an insufficient load-bearing capacity of the cured weld seams can be obtained after a reasonable amount of time, owing to exclusive ultrasonic welding of the layers of the package in the sealing region, because not all the layers of the packaging material may be firmly welded to one another.

In particular in the case of net-like packages, individual outer strands of the package may come loose from the weld seam and thus reduce the load-bearing capacity of the package in the sealing region. Furthermore, a hole may occur in the package by strands of the package coming loose from the weld seam and products can fall through the hole and out of the package.

This problem is overcome according to the invention by the use of at least one sealing element formed as a sealing strip per sealing region of a package, wherein the sealing strip additionally retains the packaging layers non-positively in the sealing region by being bent around the packaging layers after the welding.

BRIEF DESCRIPTION OF THE DRAWING

Exemplary embodiments of the device for sealing packages according to the invention and the method for sealing packages according to the invention are illustrated in the following drawings, in which:

FIG. 4 shows a perspective detailed view of a forming device for a sealing strip during and after the sealing strip has been pushed in.

DETAILED DESCRIPTION OF THE INVENTION

Figure 1:
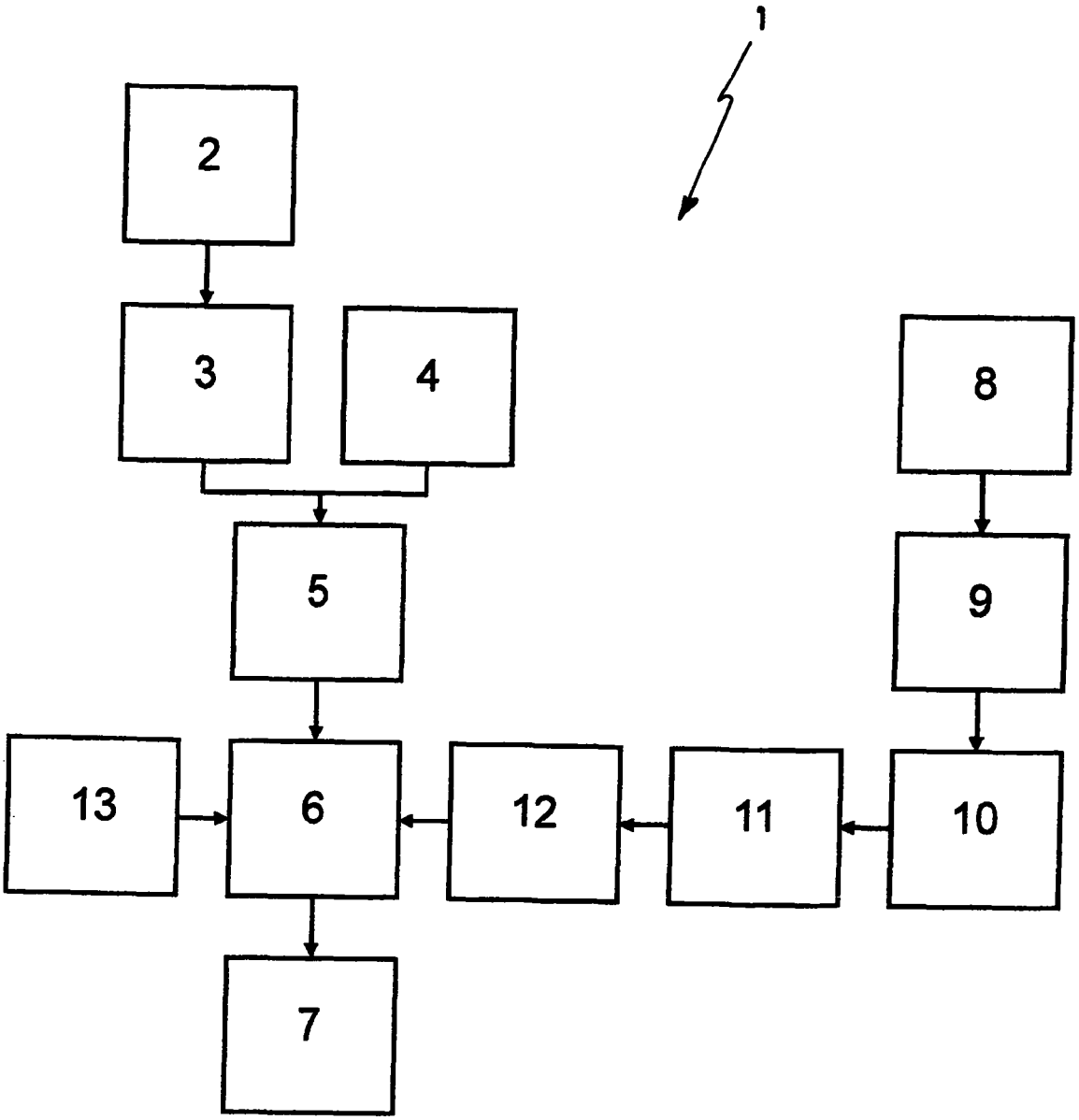
FIG. 1 shows a block diagram of an embodiment of a device for sealing packages according to the invention.

A block diagram of an exemplary embodiment of a device for sealing packages (1) according to the invention is shown in FIG. 1. The device for sealing packages (1) has a packaging means storage apparatus (2), a packaging means feed unit (3), and a product feed unit (4). The tubular packaging means stored in the region of the packaging means storage apparatus (2) can be fed by means of the packaging means feed unit (3) to those apparatuses of the device for sealing packages (1) which are designed for filling and sealing the packages.

The device for sealing packages (1) according to the invention furthermore has a clamping device (5) by means of which the tube of packaging material can be clamped and hence can be immobilized. The device for sealing packages (1) moreover has a sealing device (6) which is formed as a welding device and by means of which a package can be welded or fused in a sealing region with a sealing element formed as a sealing strip.

The device for sealing packages (1) moreover has a sealing tape stock (8) from which the sealing tape can be transported by means of a transporting apparatus (9) into the region of a cutting device (10). The sealing tape can be cut to length by means of the cutting device (10) into sealing strips of a defined length. The sealing strip can be formed into a U shape by means of a forming device (11). The sealing strip which is pushed over the package in the sealing region can be bent around the package with the aid of a bending device (12) and can then be welded to the package by means of the sealing device (6) formed as a welding device. In order to increase the production rate, the device for sealing packages (1) moreover has a cooling apparatus (13) by means of which the sealing region can be cooled after welding the package and the sealing strip.

The device for sealing packages (1) furthermore has a separating device (7) by means of which filled and/or sealed packages can be separated from the packaging means tube of the packaging means stock.

Figure 2:
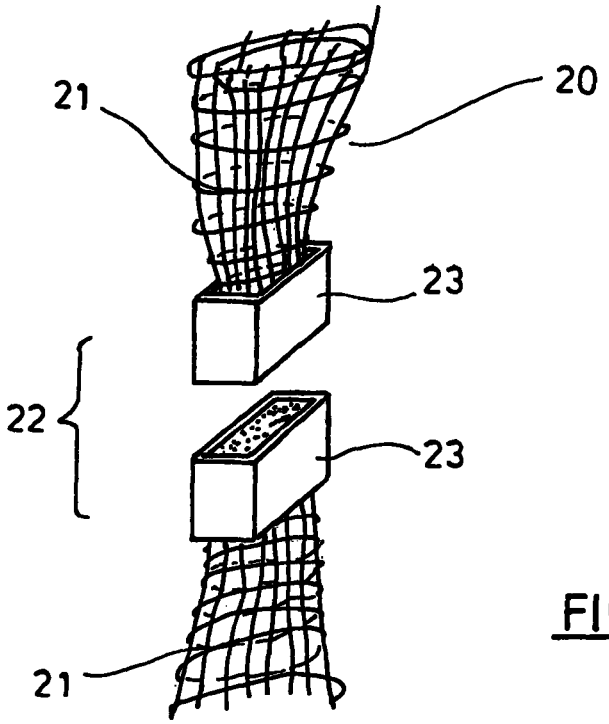
FIG. 2 shows a perspective view of the sealing region of two tubular packages.

FIG. 2 shows a perspective view of the sealing region (22) of two tubular packages (20) which have a tubular packaging means (21) in the form of a net. In the sealing region (22), the packages (20) are enclosed with a sealing element (23) formed as a sealing strip which is in each case welded or fused to the package (20).

Figure 3:
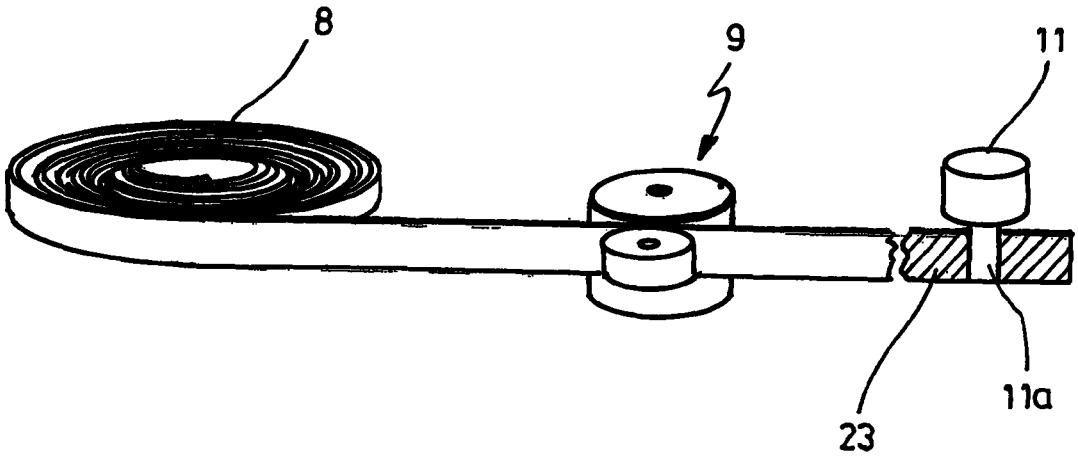
FIG. 3 shows a perspective view of a roll of sealing tape with a subsequent transporting apparatus and part of a forming device.

A perspective view of sealing tape stock (8), formed as a roll of sealing tape, with an adjacent transporting apparatus (9) and part of the forming device (11) is illustrated in FIG. 3. The sealing tape can be unreeled from the roll of sealing tape by means of the transporting apparatus (9) and can be transported into the region of the cutting device (10) (not shown) and the forming device (11). The sealing element (23), formed as a sealing strip and separated from the sealing tape by means of the cutting device (10), can be formed by means of the pusher (11*a*) of the forming device (11).

Figure 4:
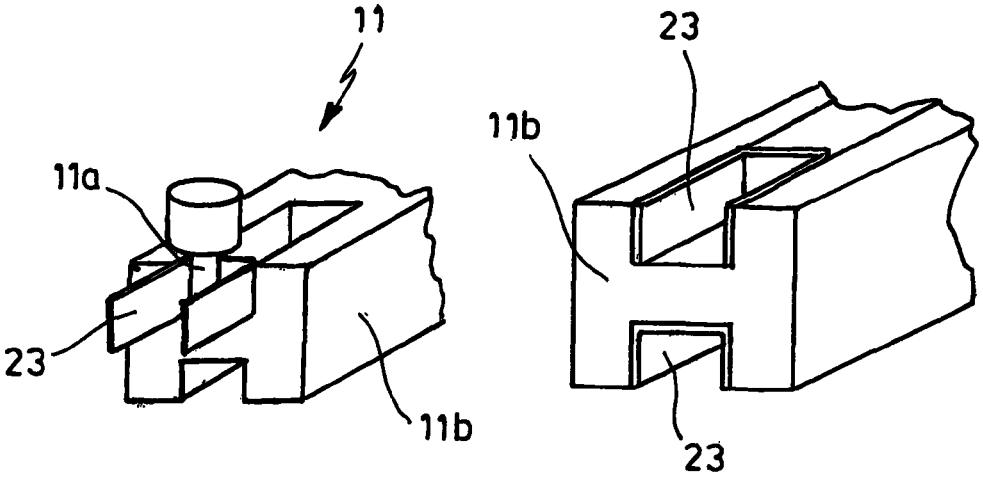

FIG. 4 shows a perspective detailed view of a forming device (11) for a sealing element (23) formed as a sealing strip on the left-hand side of the drawing while the sealing strip is being pushed into the die (11*b*) by means of the pusher (11*a*), and on the right-hand side after the sealing strip has been pushed into the die (11*b*). The die (11*b*) of the forming device (11) has two rectangular recesses into which in each case one sealing strip can be pushed by means of a pusher (11*a*) formed as a bending pin and can be formed into a U shape. The die (11*b*) illustrated is designed for the simultaneous forming of two sealing strips.

Figure 5:
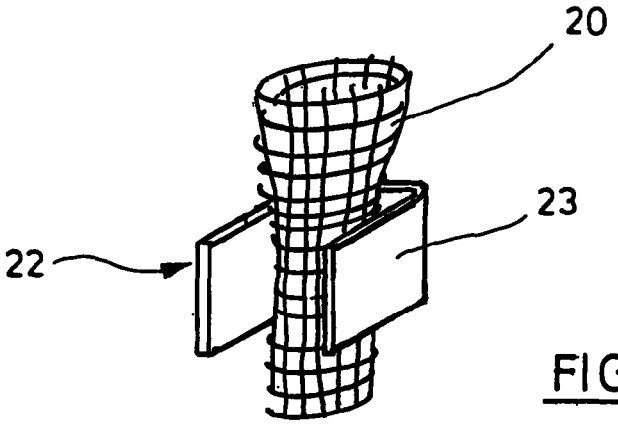
FIG. 5 shows a perspective detailed view of the sealing region of a package with a sealing strip pushed on, and FIG. 6 shows a cross-section in the sealing region of a package, wherein the package is arranged in the region of the welding device and the bending device of a device for sealing packages according to the invention.

A perspective detailed view of the sealing region (22) of a package (20) with a pushed-on, U-shaped sealing element (23) formed as a sealing strip is illustrated in FIG. 5.

Figure 6:
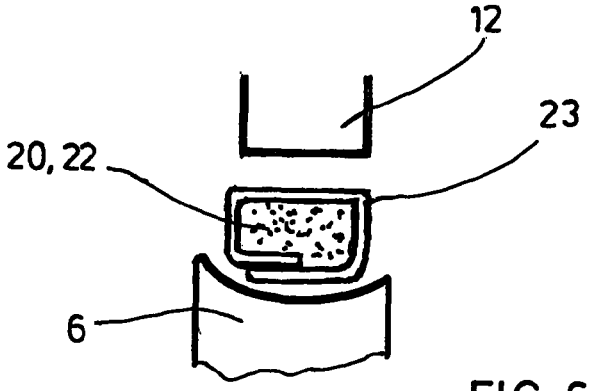

FIG. 6 shows a cross-section in the sealing region (22) of a package (20). The package (20) is arranged in the region of the sealing device (6) formed as an ultrasonic welding device and of the bending device (12) of a device for sealing packages (1) according to the invention. The sealing element (23) formed as a sealing strip is bent around the package (20) in the sealing region (22). The sealing strip can here be bent around the package (20) by means of the bending device (12) by being pressed against the end side of the sealing device (6) formed as an ultrasonic welding device by means of the bending device (12). In order to assist the folding of the sealing strip down around the package (20), in the illustrated embodiment of a device for sealing packages (1) according to the invention, the end side of the ultrasonic welding device (6) is rounded into a U shape.

Drive elements employed in the region of the device can be formed, for example, as pneumatic piston/cylinder arrangements. However, alternatively or additionally, it has also been considered to implement some or all of the drives as electric motors. It is preferably considered to implement corresponding electrical drives as stepping motors. Stepping motors of this type assist a very precise approach to a preselected position and hence a very high degree of repeatability when performing movements.

The abovementioned drives can be used, for example, for positioning the clamping device (5). Other possible applications consist of positioning the sealing device (6) and/or the cutting device (10) and/or the forming device (11). Likewise, corresponding drives for the weighing device (12) and/or the separating device (7) and/or the forming device (11) and/or the ultrasonic welding device (6) can be used.

The invention claimed is:

1. A device for sealing packages, comprising:

a product feed unit;

a packaging material feed unit for a tubular packaging material;

a transporting apparatus for at least one sealing tape and/or sealing elements formed as sealing strips; and a sealing device by which at least one package is encloseable in at least one sealing region with a sealing element formed as a sealing strip and by which a materially bonded connection of the sealing strip to the package is produced, wherein the sealing device includes a welding device, and wherein the device is configured to seal the packages with sealing elements formed from the same material as the packages so as to produce packages of a single type, wherein the welding device is a U-shaped Sonotrode having two end regions configured to produce ultrasonic welds in the end regions so that two weld seams are simultaneously produced.

2. The device according to claim 1, wherein the welding device is an ultrasonic welding device.

3. The device according to claim 1, wherein the sealing device includes an adhesive-bonding device.

4. The device according to claim 1, wherein the device is configured to seal packaging nets.

5. The device according to claim 1, further comprising a forming device configured to form the sealing strip into a U-shape.

6. A method for sealing packages, comprising the steps of: enclosing one end of a package with a sealing element formed as a sealing strip; and connecting the sealing strip to the package by ultrasonic welding, further including, in a sequence of steps: producing at least one sealing strip by cutting the at least one strip to length from at least one sealing tape and bending the at least one sealing strip around the package in a sealing region, wherein the same material is used for the sealing strip and the package, the ultrasonic welding being carried out by a U-shaped ultrasonic sonotrode having to end regions whereby ultrasonic welds are produced in the two end regions so that two weld seams are simultaneously produced.

7. The method according to claim 6, including using a device for sealing packages, which device comprises: a product feed unit; a packaging material feed unit for a tubular packaging material; a transporting apparatus for at least one sealing tape and/or sealing elements formed as sealing strips; and a sealing device by which at least one package is encloseable in at least one sealing region with a sealing element formed as a sealing strip and by which a materially bonded connection of the sealing strip to the package is produced, wherein the sealing device includes a welding device, and wherein the device is configured to seal the packages with sealing elements formed from the same material as the packages so as to produce packages of a single type, wherein the welding device is the U-shaped Sonotrode.

* * * * *